United States Patent [19]

Taylor

[11] 3,983,189

[45] Sept. 28, 1976

[54] CARBURETOR

[75] Inventor: Roland S. Taylor, Fairport, N.Y.

[73] Assignee: General Motors Corporation, Detroit, Mich.

[22] Filed: Aug. 21, 1974

[21] Appl. No.: 499,332

[52] U.S. Cl. ..... 261/23 A; 261/67; 261/69 R

[51] Int. Cl.[2] ..... F02M 7/16

[58] Field of Search ..... 261/23 A, 69 R, 67

[56] References Cited

UNITED STATES PATENTS

| | | | |
|---|---|---|---|
| 2,227,267 | /1940 | Lozivit | 261/39 A |
| 2,341,694 | 2/1944 | Coffey | 261/39 |
| 2,661,196 | 12/1953 | Ball | 261/41 |
| 2,803,443 | 8/1957 | Dillon | 261/41 |
| 3,011,770 | /1961 | Stoltman | 261/69 R |
| 3,059,909 | /1962 | Wise | 261/39 D |
| 3,109,043 | /1963 | Carlson et al. | 261/23 A |
| 3,172,923 | 3/1965 | Romeo et al. | 261/69 |
| 3,343,820 | 9/1967 | Elliott | 261/23 |
| 3,588,058 | /1971 | Lucas | 261/67 |
| 3,628,773 | 12/1971 | Kehoe | 261/23 |
| 3,659,572 | /1972 | Pelizzoni | 261/41 R |
| 3,664,313 | /1972 | Walker | 261/69 R |
| 3,795,387 | /1974 | Hebert | 261/69 R |
| 3,800,766 | /1974 | Schubeck | 261/67 |
| 3,859,397 | /1975 | Tryon | 261/39 A |
| 3,872,188 | /1975 | Brown et al. | 261/69 R |

*Primary Examiner*—Tim R. Miles
*Assistant Examiner*—Gregory N. Clements
*Attorney, Agent, or Firm*—C. K. Veenstra

[57] ABSTRACT

In a four-barrel carburetor, a pair of plain tube primary mixture conduits each has a main well receiving fuel through a main jet controlled by a metering rod which is positioned by a vacuum responsive piston. An auxiliary fuel passage receives fuel both through an auxiliary jet controlled by a metering rod positioned by a vacuum responsive piston and through a supplementary jet controlled by a metering rod positioned by an ambient pressure responsive bellows. A pair of transfer passages respectively connect the auxiliary fuel passage to the main wells.

4 Claims, 9 Drawing Figures

CARBURETOR

This invention relates to a carburetor and more particularly to a carburetor having an improved main metering system.

In the well-known Rochester Products "Quadrajet" carburetor, a pair of plain tube primary mixture conduits each has a main well receiving fuel through a main jet controlled by a metering rod which is positioned by a vacuum responsive piston. Usually the vacuum piston has a single spring biasing the piston and metering rods to a position permitting maximum flow of fuel through the main jets and thus providing a power air-fuel mixture. The piston is responsive to induction system vacuum which, under many conditions of operation, pulls the piston and metering rods against the spring bias to restrict fuel flow through the main jets and thus provide an economy air-fuel mixture.

In at least one application, however, the vacuum responsive piston has been provided with a pair of springs, one continuously biasing the piston and metering rods toward a position permitting maximum flow of fuel through the main jets and thus providing a power air-fuel mixture. Under some conditions of operation, induction system vacuum pulls the piston against the bias of the one spring until it meets the bias of the second spring; in this position the metering rods partially restrict fuel flow through the main jets to provide an intermediate air-fuel mixture. Under other conditions of operation, induction system vacuum overcomes the bias of both springs and positions the piston and metering rods to further restrict fuel flow through the main jets and thus provide an economy air-fuel mixture.

In another situation, it was proposed that a carburetor main well be directly fed by both a main jet and an auxiliary jet and that a single piston position a main metering rod in the main jet and an auxiliary metering rod in the auxiliary jet. The metering rods were individually spring biased, and variations in induction system vacuum caused the piston to sequentially overcome the spring bias to provide a power air-fuel mixture, an intermediate air-fuel mixture and an economy air-fuel mixture.

In yet another situation, it was proposed that a carburetor main well be directly fed by both a main jet and a supplementary jet with the main jet controlled by a metering rod responsive to carburetor throttle position and the supplementary jet controlled by a metering rod positioned by an ambient pressure responsive bellows.

In the well-known Rochester Products "2G" carburetor, a pair of plain tube mixture conduits each have a main well receiving fuel through a main jet providing an economy air-fuel mixture. An auxiliary jet has a valve which is operated by a piston responsive to induction system vacuum. A spring biases the piston to open the valve and permit additional fuel flow to the main wells to provide a power air-fuel mixture.

This invention provides a carburetor having a plain tube mixture conduit with a main well which receives fuel through main and auxiliary jets controlled by main and auxiliary metering rods, respectively, and in which the main and auxiliary metering rods are independently positioned by main and auxiliary vacuum pistons, respectively. In providing such a construction, this invention provides a carburetor having a main metering system which may be easily tailored to the carburetor operating requirements.

Furthermore, this invention provides a carburetor having — in addition to the features set forth in the preceding paragraph — a supplementary jet controlled by a supplementary metering rod positioned by a bellows responsive to ambient pressure. This additional feature further extends the ability to tailor the main metering system to the carburetor operating requirements.

In the preferred embodiment, this invention provides a carburetor having a pair of plain tube mixture conduits — each with a main well, main jet, and main metering rod — a single vacuum piston positioning both main metering rods, a single auxiliary jet and vacuum piston positioned auxiliary metering rod supplying fuel to both main wells, and a single supplementary jet and bellows positioned supplementary metering rod also supplying fuel to both main wells. With this construction, this invention provides a carburetor in which the main metering system has a substantially enhanced capability for tailoring to carburetor operating requirements with a minimum of additional complexity.

The details as well as other features and advantages of this invention are set forth in the remainder of the specification and are shown in the drawings in which.

Figure 1:
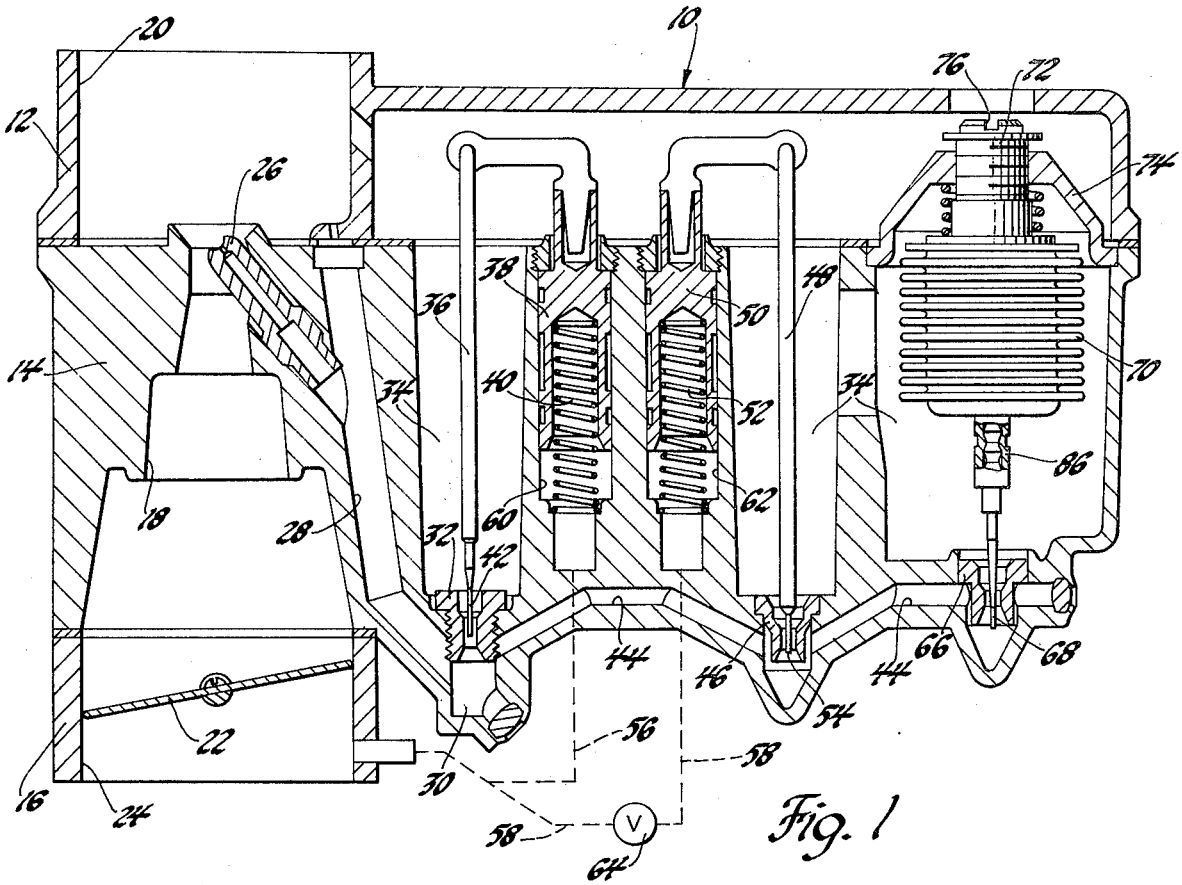
FIG. 1 is a schematic view of a carburetor, in sectional elevation, showing the components of this new main metering system.

Referring first to FIG. 1, a carburetor 10 has an air horn section 12, a fuel bowl section 14, and a throttle body section 16. The fuel bowl section 14 has a venturi cluster 18 which receives air through an air inlet 20 in air horn section 12 and which discharges an air-fuel mixture past a throttle 22 disposed in an outlet 24 in throttle body section 16. Air inlet 20, venturi cluster 18, and outlet 24 define a plain tube carburetor mixture conduit or induction passage.

A nozzle 26 discharges fuel from a fuel passage or main well 28 into venturi cluster 18 for mixture with the air flow therethrough. Main well 28 has a lower portion 30 which receives fuel through a main metering orifice or jet 32 from a fuel bowl region 34. A main metering rod 36 is positioned by a main vacuum piston 38 and, when lowered against the bias of spring 40, restricts fuel flow through main jet 32. When spring 40 lifts piston 38, a reduced portion 42 on metering rod 36 permits increased fuel flow through main jet 32.

An auxiliary fuel passage 44 opens into the lower portion 30 of main well 28. An auxiliary metering orifice or jet 46 opens into auxiliary passage 44 from fuel bowl region 34. Auxiliary jet 46 is controlled by an auxiliary metering rod 48 which is positioned by an auxiliary vacuum piston 50. When vacuum piston 50 is lowered against the bias of a spring 52, auxiliary rod 48 restricts fuel flow through auxiliary jet 46. When auxiliary piston 50 and auxiliary rod 48 are lifted by spring 52, a reduced portion 54 on rod 48 permits increased fuel flow through auxiliary jet 46.

Passages 56 and 58, indicated by the dotted lines in FIG. 1, connect main and auxiliary vacuum piston cylinders 60 and 62 to the induction passage below throttle 22, thus subjecting main piston 38 and auxiliary piston 50 to the induction system or manifold vacuum therein. If desired, a valve 64 may control flow through passage 58; with valve 64 obstructing passage 58, air at substantially atmospheric pressure within the upper portion of fuel bowl region 34, under air horn 12, leaks around the edges of auxiliary piston 50, thus permitting spring 52 to raise auxiliary piston 50 and auxiliary rod 48. Alternatively, valve 64 may control an air bleed into passage 58; with valve 64 opening the air bleed to admit air into passage 58, spring 52 lifts piston 50 and rod 48. In either case, the reduced portion 54 of auxiliary rod 48 then permits increased flow through auxiliary jet 46.

Carburetor 10 is especially suitable for use on an engine having an exhaust gas reducing converter. In this application, when the reducing converter is in operation, carburetor 10 should provide a rich air-fuel mixture (having an air-fuel ratio (A/F) of about 14/1 for example) during most conditions of operation and a power air-fuel mixture (having an A/F of perhaps 13/1 for example) during low manifold vacuum conditions of operation. When the reducing converter is not in operation, such as during high temperature or high speed conditions of operation for example, carburetor 10 should provide an economy air-fuel mixture (having an A/F of perhaps 16/1 for example) during most conditions of operation and a power air-fuel mixture (having an A/F of perhaps 13/1 for example) during low manifold vacuum conditions of operation.

These A/F requirements are satisfied in carburetor 10. When the reducing converter is in operation, valve 64 is caused to obstruct or vent passage 58 whereupon spring 52 will lift auxiliary piston 50 and rod 48, and auxiliary jet 46 and rod 48 are calibrated with main jet 32 and rod 36 to provide a rich A/F of about 14/1 when main piston 38 and rod 36 are lowered against the bias of spring 40 and a power A/F of perhaps 13/1 when spring 40 raises main piston 38 and rod 36. When the reducing converter is not in operation, valve 64 is caused to admit manifold vacuum to auxiliary cylinder 62 whereupon auxiliary piston 50 and rod 48 will respond to variations in manifold vacuum, and auxiliary jet 46 and rod 48 are calibrated with main jet 32 and rod 36 to provide an economy A/F of perhaps 16/1 when both main piston 38 and rod 36 and auxiliary piston 50 and rod 48 are lowered and a power A/F of perhaps 13/1 when both main piston 38 and rod 36 and auxiliary piston 50 and rod 48 are raised. In this regard, it may be desirable for main piston spring 40 to raise main piston 38 and rod 36 as the manifold vacuum decreases from about 5 to about 3 inches of mercury for example and for auxiliary piston spring 52 to raise auxiliary piston 50 and rod 48 as manifold vacuum decreases from about 9 to about 6 inches of mercury for example. It will be appreciated, of course, that the precise calibrations of main jet 32 and rod 36 and of auxiliary jet 46 and rod 48, the characteristics of springs 40 and 52, and the structure and operation of valve 64 are matters of choice.

Carburetor 10 also is especially suitable for use on an engine having an exhaust gas converter in which exhaust gas oxides of nitrogen are reduced while exhaust gas hydrocarbons and carbon monoxide are simultaneously oxidized. In this application, carburetor 10 should provide a stoichiometric air-fuel mixture (having an A/F of about 14.7/1) during most conditions of operation and a power air-fuel mixture (having an A/F of perhaps 13/1 for example) during low manifold vacuum conditions of operation.

These A/F requirements are satisfied in carburetor 10 by providing a taper on auxiliary rod 48 and by causing valve 64 to continuously vary the vacuum level in auxiliary cylinder 62 in accordance with a signal indicative of the A/F delivered to the engine. (As one example, zirconia exhaust gas sensors are known to provide a voltage signal inversely proportional to the exhaust gas oxygen concentration and thus inversely proportional to the A/F delivered to the engine; valve 64 may be a proportioning solenoid which provides decreased pressure in auxiliary cylinder 62 as the sensor voltage increases and increased pressure in auxiliary cylinder 62 as the sensor voltage decreases.) Auxiliary jet 46 and rod 48 are calibrated with main jet 32 and rod 36 to provide a stoichiometric A/F of about 14.7/1 when main piston 38 and rod 36 are lowered and auxiliary piston 50 and rod 48 are in a position intermediate their uppermost and lowermost positions and to provide a power A/F of perhaps 13/1 when both main piston 38 and rod 36 and auxiliary piston 50 and rod 48 are fully raised. In this regard, it may be desirable for springs 40 and 52 to raise pistons 38 and 50 and rods 36 and 48 as manifold vacuum decreases from about 5 to about 3 inches of mercury for example. Here, too, it will be appreciated that the precise calibrations of main jet 32 and rod 36 and of auxiliary jet 46 and rod 48, the characteristics of springs 40 and 52, and the structure and operation of valve 64 are matters of choice.

Carburetor 10 further is especially suitable for use on an engine requiring an economy air-fuel mixture (having an A/F of perhaps 16/1 for example) under high manifold vacuum conditions of operation, a power air-fuel mixture (having an A/F of perhaps 13/1 for example) under low manifold vacuum conditions of operation, and an intermediate air-fuel mixture (having an A/F of perhaps 15/1 for example) during intermediate manifold vacuum conditions of operation.

These A/F requirements are satisfied in carburetor 10 by omitting valve 64 and by calibrating auxiliary jet 46 and rod 48 with main jet 32 and rod 36 to provide an economy A/F of perhaps 16/1 when both main piston 38 and rod 36 and auxiliary piston 50 and rod 48 are lowered, to provide a power A/F of perhaps 13/1 when both main piston 38 and rod 36 and auxiliary piston 50 and rod 48 are raised, and to provide an intermediate A/F of perhaps 15/1 when main piston 38 and rod 36 are lowered while auxiliary piston 50 and rod 48 are raised. In this regard, it may be desirable for spring 52 to raise auxiliary piston 50 and rod 48 as manifold vacuum decreases from about 9 to about 7 inches of mercury for example and for spring 40 to raise main piston 38 and rod 36 as manifold vacuum decreases from about 5 to about 3 inches of mercury for example. Here again, however, it will be appreciated that the precise calibrations of main jet 32 and rod 36 and of auxiliary jet 46 and rod 48 and the characteristics of springs 40 and 52 are matters of choice.

It will be further appreciated that it may be desirable that spring 52 raise auxiliary piston 50 at a higher manifold vacuum than spring 40 raises main piston 38, and that a valve 64 could be disposed in either or both of passages 56 and 58. Moreover, additional springs could be used with either or both of pistons 38 and 50.

A supplementary metering orifice or jet 66 also opens from fuel bowl region 34 into auxiliary passage 44. A tapered supplementary metering rod 68 controls flow through supplementary jet 66. Metering rod 68 is secured to a bellows 70 which is responsive to the pressure in fuel bowl 34 under air horn 12 and thus is responsive to the ambient atmospheric pressure. As the ambient pressure increases, bellows 70 is compressed to lift metering rod 68 and permit an increased flow of fuel through supplementary jet 66; as the ambient pressure decreases, bellows 70 expands to lower supplementary rod 68 in supplementary jet 66 and restrict the flow of fuel therethrough. Bellows 70 thereby causes supplementary rod 68 to vary the fuel flow to venturi cluster 18 in accordance with variations in atmospheric pressure and thus prevent variations in the air-fuel mixture which would otherwise occur due to changes in the air mass flow through the induction passage with variations in atmospheric pressure.

Bellows 70 has a stem 72 which is threaded through a bellows cover and supporting member 74 secured in fuel bowl section 12. Stem 72 has a slotted head 76 by which stem 72, bellows 70 and supplementary rod 68 may be rotated to adjust the position of rod 68 in supplementary jet 66. This construction permits adjustment of the part throttle air-fuel mixture provided by the carburetor.

Figure 2:
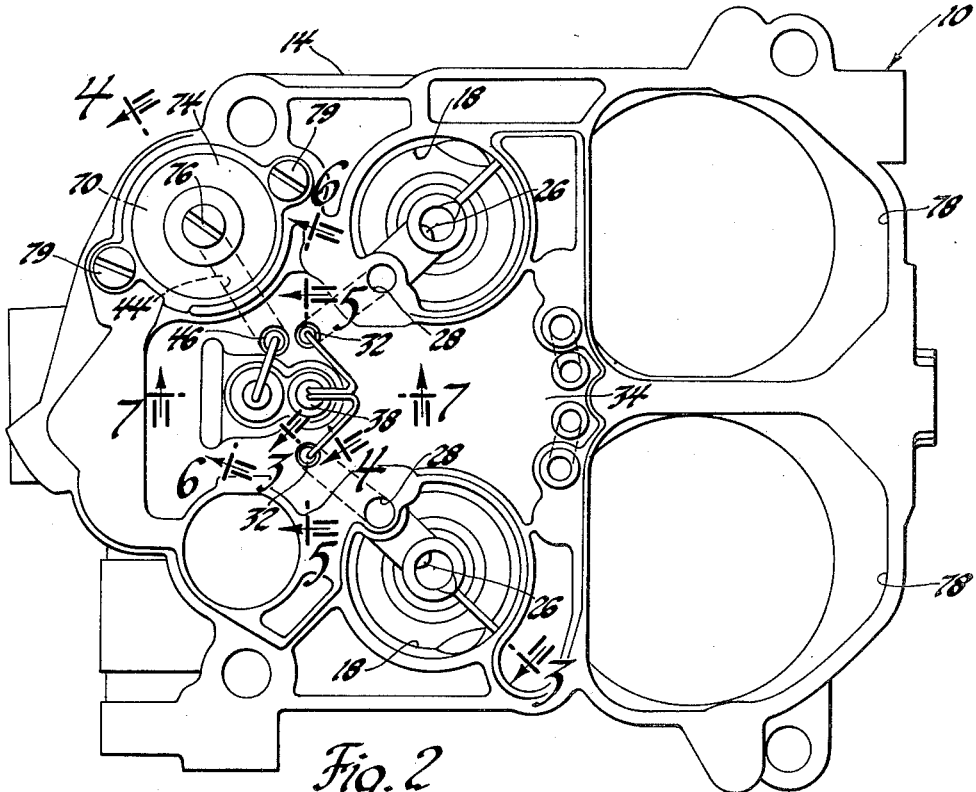
FIG. 2 is a plan view of the fuel bowl section of the preferred embodiment showing the layout of the main metering system.

In referring to the fuel bowl section shown in FIGS. 2 through 7, identical reference numbers are used to identify the actual components with those shown schematically in FIG. 1. As shown in FIG. 2, fuel bowl section 14 has a central fuel bowl region 34 disposed between a pair of primary induction passage venturi clusters 18. A pair of secondary mixture passages 78 are disposed at one end of fuel bowl 34. Main and auxiliary vacuum pistons 38 and 50 are disposed within fuel bowl region 34 approximately on the carburetor center line. Bellows 70 is disposed in one corner of fuel bowl region 34, and its cover member 74 is retained by a pair of screw heads 79.

Figure 3:
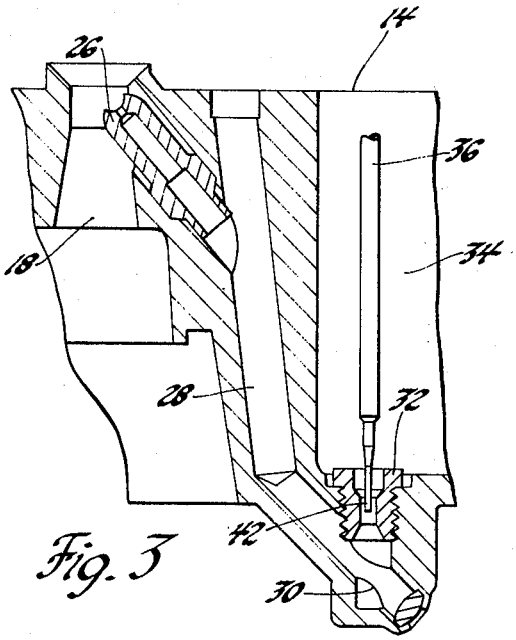
FIG. 3 is a sectional view along line 3—3 of FIG. 2, enlarged to show one of the main wells, main jets, and main metering rods.

As shown in FIGS. 2 and 3, each venturi cluster 18 has a nozzle 26 receiving fuel from a main well 28. Main jets 32 are disposed on opposite sides of main power piston 38, and each opens into the lower portion 30 of a main well 28.

Figure 4:
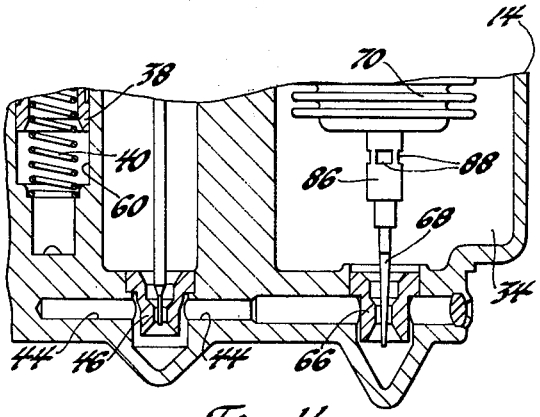
FIG. 4 is a sectional view along line 4—4 of FIG. 2, enlarged to show the main vacuum piston, auxiliary fuel passage, auxiliary jet, auxiliary metering rod, supplementary jet, supplementary metering rod, and bellows.
Figure 5:
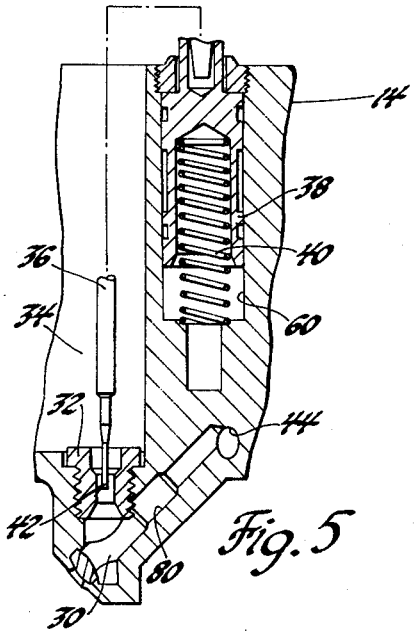
FIG. 5 is a sectional view along line 5—5 of FIG. 2, enlarged to show one of the transfer passages which leads from the auxiliary fuel passage to the associated main well.

As shown in FIGS. 2 and 4, auxiliary passage 44 extends from beneath bellows 70, under auxiliary jet 46 and terminates below main piston 38. Transfer passages 80, one of which is shown in FIG. 5, extend from auxiliary passage 44 to the lower portions 30 of main wells 28. This construction provides substantially identical flow paths from auxiliary and supplementary jets 46 and 66 to each of main wells 28 to assure that fuel flow from jets 46 and 66 is properly divided between main wells 28.

Figure 6:
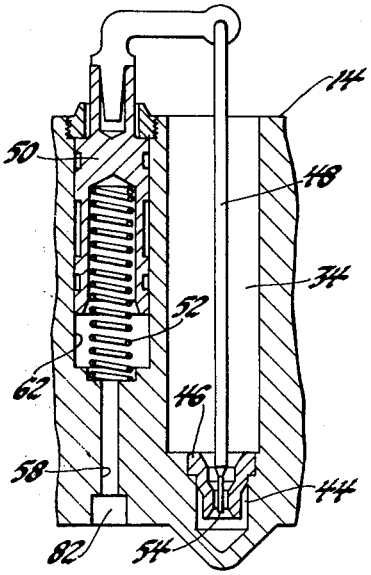
FIG. 6 is a sectional view along line 6—6 of FIG. 2, enlarged to show the auxiliary jet, auxiliary metering rod, and auxiliary vacuum piston.
Figure 7:
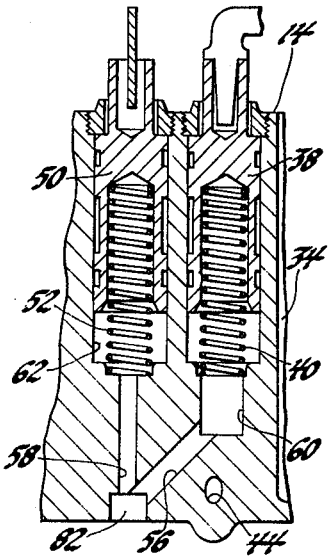
FIG. 7 is a sectional view along line 7—7 of FIG. 2, enlarged to show the main and auxiliary vacuum pistons and the auxiliary fuel passage.

As shown in FIGS. 6 and 7, passages 56 and 58 comprise passages drilled in fuel bowl section 14. Of course, if a valve 64 were included in either passage, passages 56 and 58 would not have a common portion 82 as illustrated in FIG. 7.

Figure 8:
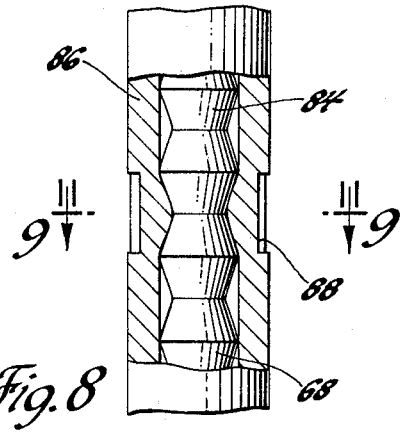
FIG. 8 is a view of a portion of FIGS. 1 and 4, further enlarged to show the manner in which the supplementary metering rod is secured to the bellows.
Figure 9:
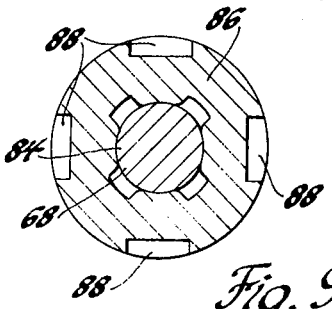
FIG. 9 is a sectional view along line 9—9 of FIG. 8, further enlarged to show details of the interengagement between the supplementary metering rod and the bellows.

Referring now to FIGS. 8 and 9, supplementary metering rod 68 has a ridged upper portion 84 received in a cylindrical sleeve 86 secured to bellows 70. When assembling the carburetor, it is desired that the overall length from bellows cover member 74 to the lower end of supplementary rod 68 be within a limited tolerance. However, the manufactured length of bellows 70 may vary from unit to unit due to manufacturing tolerances. Accordingly, supplementary rod 68 is inserted in sleeve 86 and positioned to achieve the desired overall length. Sleeve 86 is then staked about the ridged portion 84 of supplementary rod 78 at a plurality of peripherally spaced locations 88, thus securing and retaining supplementary rod 78 within sleeve 86.

It will be appreciated from the foregoing that this invention provides a carburetor having a main metering system which may be easily tailored to the carburetor operating requirements. Each of the main and auxiliary vacuum pistons and metering rods operates completely independently of the other and of the part throttle adjustment and altitude or ambient pressure compensation provided through supplementary rod 68, and yet only one auxiliary jet-rod-vacuum piston and only one supplementary jet-rod-bellows are required to supplement the fuel delivery of the independent main jets.

The embodiments of the invention in which an exclusive property or privilege is claimed are defined as follows:

1. A carburetor comprising a fuel bowl, first and second air induction passages disposed on opposite sides of said bowl, each of said passages having a venturi disposed therein, throttle means disposed in said induction passages for controlling air flow therethrough, first and second fuel passages extending to said venturis respectively whereby fuel may be delivered thereto and mixed with air therein, first and second main metering orifices opening from opposite sides of said bowl to said first and second passages respectively, first and second main metering rods controlling fuel flow through said first and second orifices respectively, a main piston disposed between said orifices and connected to said metering rods, an auxiliary fuel passage extending beneath said piston, auxiliary and supplementary metering orifices opening from said bowl to said auxiliary passage, auxiliary and supplementary metering rods disposed in and controlling fuel flow through said auxiliary and supplementary orifices respectively, an auxiliary piston disposed adjacent said main piston and connected to said auxiliary rod, passage means for subjecting said pistons to the pressure in at least one of said induction passages downstream of said throttle means whereby said main piston may cause said main rods to restrict fuel flow through said main orifices and said auxiliary piston may cause said auxiliary rod to restrict fuel flow through said auxiliary orifice in response to decreases in said pressure below selected values, springs biasing said main and auxiliary pistons and rods to permit increased flow through said main and auxiliary orifices, a bellows connected to said supplementary rod and exposed to the ambient pressure whereby said bellows may cause said supplementary rod to restrict fuel flow through said supplementary orifice upon a decrease in ambient pressure and to permit increased fuel flow through said supplementary orifice upon an increase in ambient pressure, and first and second transfer passages extending from said auxiliary passage beneath said main piston to said first and second fuel passages beneath said first and second orifices respectively whereby fuel flow through said auxiliary and supplementary orifices may be appropriately divided between and delivered to said venturis.

2. A carburetor comprising a fuel bowl, first and second air induction passages disposed on opposite sides of said bowl, each of said passages having a venturi disposed therein, throttle means disposed in said induction passages for controlling air flow therethrough, first and second fuel passages extending to said venturis respectively whereby fuel may be delivered thereto and mixed with air therein, first and second main metering orifices opening from opposite sides of said bowl to said first and second passages respectively, first and second main metering rods controlling fuel flow through said first and second orifices respectively, a main piston disposed between said orifices and connected to said metering rods, an auxiliary fuel passage extending beneath said piston, an auxiliary metering orifice opening from said bowl to said auxiliary passage, an auxiliary metering rod disposed in and controlling fuel flow through said auxiliary orifice, an auxiliary piston disposed adjacent said main piston and connected to said auxiliary rod, passage means for subjecting said pistons to the pressure in at least one of said induction passages downstream of said throttle means whereby said main piston may cause said main rods to restrict fuel flow through said main orifices and said auxiliary piston may cause said auxiliary rod to restrict fuel flow through said auxiliary orifice in response to decreases in said pressure below selected values, and springs biasing said main and auxiliary pistons and rods to permit increased flow through said main and auxiliary orifices, and first and second transfer passages extending from said auxiliary passage beneath said main piston to said first and second fuel passages beneath said first and second orifices respectively whereby fuel flow through said auxiliary orifice may be appropriately divided between and delivered to said venturis.

3. A carburetor comprising a fuel bowl, first and second air induction passages disposed on opposite sides of said bowl, each of said passages having a venturi disposed therein, throttle means disposed in said induction passages for controlling air flow therethrough, first and second fuel passages extending to said venturis respectively whereby fuel may be delivered thereto and mixed with air therein, first and second main metering orifices opening from opposite sides of said bowl to said first and second passages respectively, first and second main metering rods controlling fuel flow through said first and second orifices respectively, a main piston disposed between said orifices and connected to said metering rods, an auxiliary fuel passage extending beneath said piston, auxiliary and supplementary metering orifices opening from said bowl to said auxiliary passage, auxiliary and supplementary metering rods disposed in and controlling fuel flow through said auxiliary and supplementary orifices respectively, an auxiliary piston disposed adjacent said main piston and connected to said auxiliary rod, passage means for subjecting said pistons to the pressure in at least one of said induction passages downstream of said throttle means whereby said main piston may cause said main rods to restrict fuel flow through said main orifices and said auxiliary piston may cause said auxiliary rod to restrict fuel flow through said auxiliary orifice in response to decreases in said pressure below selected values, springs biasing said main and auxiliary pistons and rods to permit increased flow through said main and auxiliary orifices, a bellows connected to said supplementary rod and exposed to the ambient pressure whereby said bellows may cause said supplementary rod to restrict fuel flow through said supplementary orifice upon a decrease in ambient pressure and to permit increased fuel flow through said supplementary orifice upon an increase in ambient pressure, a supporting member for said bellows, a stem connected to said bellows and threadedly received by said member to permit adjustment of the position of said bellows relative to said supplementary orifice and thus the position of said supplementary rod with said supplementary orifice, and first and second transfer passages extending from said auxiliary passage beneath said main piston to said first and second fuel passages beneath said first and second orifices respectively whereby fuel flow through said auxiliary and supplementary orifices may be appropriately divided between and delivered to said venturis.

4. A carburetor comprising a fuel bowl, first and second air induction passages disposed on opposite sides of said bowl, each of said passages having a venturi disposed therein, throttle means disposed in said induction passages for controlling air flow therethrough, first and second fuel passages extending to said venturis respectively whereby fuel may be delivered thereto and mixed with air therein, first and second main metering orifices opening from opposite sides of said bowl to said first and second passages respectively, first and second main metering rods controlling fuel flow through said first and second orifices respectively, a main piston disposed between said orifices and connected to said metering rods, an auxiliary fuel passage extending beneath said piston, auxiliary and supplementary metering orifices opening from said bowl to said auxiliary passage, auxiliary and supplementary metering rods disposed in and controlling fuel flow through said auxiliary and supplementary orifices respectively, an auxiliary piston disposed adjacent said main piston and connected to said auxiliary rod, passage means for subjecting said pistons to the pressure in at least one of said induction passages downstream of said throttle means whereby said main piston may cause said main rods to restrict fuel flow through said main orifices and said auxiliary piston may cause said auxiliary rod to restrict fuel flow through said auxiliary orifice in response to decreases in said pressure below selected values, springs biasing said main and auxiliary pistons and rods to permit increased flow through said main and auxiliary orifices, a supporting member for said supplementary rod, said supplementary rod having a stem threadedly received by said member to permit adjustment of said supplementary rod within said supplementary orifice, and first and second transfer passages extending from said auxiliary passage beneath said main piston to said first and second fuel passages beneath said first and second orifices respectively whereby fuel flow through said auxiliary and supplementary orifices may be appropriately divided between and delivered to said venturis.

* * * * *